US006520463B1

(12) United States Patent
Ouano

(10) Patent No.: US 6,520,463 B1
(45) Date of Patent: Feb. 18, 2003

(54) MOUNTING BRACKET FOR WALL MOUNTED ACCESSORY

(75) Inventor: Magno Ouano, Jersey City, NJ (US)

(73) Assignee: Bath Unlimited, Inc., Passaic, NJ (US)

( * ) Notice: Subject to any disclaimer, the term of this patent is extended or adjusted under 35 U.S.C. 154(b) by 0 days.

(21) Appl. No.: 09/631,001

(22) Filed: Aug. 2, 2000

Related U.S. Application Data

(60) Provisional application No. 60/148,844, filed on Aug. 13, 1999.

(51) Int. Cl.[7] ..... A47B 96/00

(52) U.S. Cl. ..... 248/222.13; 248/223.41; 248/222.11

(58) Field of Search ..... 248/222.11, 222.12, 248/222.13, 223.41, 224.7, 221.11, 251, 220.22, 220.21; 211/16, 105, 123

(56) References Cited

U.S. PATENT DOCUMENTS

| | | | | | |
|---|---|---|---|---|---|
| 1,790,977 | A | | 2/1931 | De Boer | |
| 1,915,230 | A | | 6/1933 | Hooper | |
| 2,144,602 | A | * | 1/1939 | Balmer | 248/250 |
| 2,239,978 | A | | 4/1941 | Sanford | |
| 2,476,134 | A | | 7/1949 | Care | |
| 2,954,951 | A | | 10/1960 | Dorothea | |
| 3,036,803 | A | * | 5/1962 | Fiebelkorn | 248/221.11 |
| 3,270,996 | A | * | 9/1966 | Churchill | 248/23.41 |
| 3,928,894 | A | * | 12/1975 | Bury et al. | 24/73 |
| 4,340,199 | A | | 7/1982 | Brock | 248/544 |
| 4,524,506 | A | * | 6/1985 | Wilke | 248/221.3 |
| 4,524,938 | A | * | 6/1985 | Strahs | 248/224.1 |
| 4,718,625 | A | | 1/1988 | Boda | 248/222.1 |
| 4,936,533 | A | | 6/1990 | Adams et al. | 248/222.1 |
| 4,948,085 | A | | 8/1990 | Mittelhauser | 248/549 |
| 5,000,411 | A | * | 3/1991 | Primeau | 248/223.4 |
| 5,025,937 | A | | 6/1991 | King | 211/192 |
| 5,035,389 | A | | 7/1991 | Wang | 248/224.1 |
| 5,226,625 | A | | 7/1993 | Hanna | 248/222.1 |
| 5,687,942 | A | * | 11/1997 | Johnson | 248/223.41 |

* cited by examiner

*Primary Examiner*—Anita King
*Assistant Examiner*—Gwendolyn Baxter
(74) *Attorney, Agent, or Firm*—Edgar A. Zarins; Lloyd D. Doigan

(57) ABSTRACT

An accessory mounting system for maintaining an accessory post on a wall. The system includes a bracket fastened to the wall and the accessory post secured to the wall-mounted bracket. The bracket has a plurality of flanges for engaging corresponding slots in the base cavity of the post. In addition, locking fingers prevent inadvertent release of the post from the bracket.

19 Claims, 2 Drawing Sheets

MOUNTING BRACKET FOR WALL MOUNTED ACCESSORY

RELATED APPLICATIONS

This application claims priority from U.S. Provisional Application No. 60/148,844 filed on Aug. 13, 1999.

BACKGROUND OF THE INVENTION

I. Field of the Invention

This invention relates to a mounting bracket for maintaining a wall-mounted bath accessory and, in particular, to a bracket which allows sliding engagement with the accessory post to conceal the bracket within the base of the post.

II. Description of the Prior Art

Because of their weight and the weight of the items they support, wall mounted accessories must be securely mounted to the wall. Such accessories can include towel bars and rings, shelves, tumbler holders and robe hooks. The earliest accessories were mounted directly to the wall by passing fasteners through the base of the accessory. However, because these items are typically decorative, it was preferred to minimize or conceal the fasteners to provide a sleek, finished appearance. In some instances, a simple cover plate was employed to conceal the fasteners.

A popular method of mounting accessories is to first secure a mounting bracket to the wall thereafter attaching the accessory to the bracket. Such brackets may include posts or plates which are concealed by the decorative accessory. The accessory may be secured to the bracket by a single fastener typically on the underside of the accessory. However, these mounting assemblies can be cumbersome because of the size and location of these fasteners.

SUMMARY OF THE PRESENT INVENTION

The present invention overcomes the disadvantages of the prior known mounting brackets by providing a bracket which is concealed by the accessory post yet facilitates simple sliding engagement of the post onto the bracket.

The mounting system of the present invention includes a bracket which is fastened to a wall of the desired location and a post having a base housing with flanges to lockingly cooperate with the bracket. The mounting bracket has a substantially planar configuration with apertures for receiving fasteners to secure the bracket to a wall. The bracket includes a nose flange and a pair of tail flanges which are spaced away from the wall upon securing the bracket. An alignment groove is formed intermediate the tail flange to ensure proper alignment with the post. A pair of flexible locking fingers extend on opposite sides of the nose flange. Each of these components of the bracket are designed to cooperate with corresponding structure of the post.

The post of the accessory preferably includes a base portion having an underside cavity to receive the wall-mounted bracket such that the post base is flush to the wall. The cavity includes slots for receiving the nose and tail flanges of the bracket. The nose slot is formed in a peripheral wall of the cavity and the tail slots are formed in walls protruding into the cavity. A rib cooperates with the alignment groove to prevent rotation of the base relative to the bracket and ensure proper alignment prior to engagement. A pair of locking blocks extending into the cavity selectively engage the flexible fingers to maintain the post on the mounting bracket.

Once the post base is positioned over the mounting bracket, the base is slid laterally to insert the nose and tail flanges into respective slots. As the base is moved into position, the flexible fingers will lockingly engage the blocks to retard sliding disengagement of the post from the mounting bracket.

Other objects, features and advantages of the invention will be apparent from the following detailed description taken in connection with the accompanying drawings.

BRIEF DESCRIPTION OF THE DRAWING

The present invention will be more fully understood by reference to the following detailed description of a preferred embodiment of the present invention when read in conjunction with the accompanying drawing, in which like reference characters refer to like parts throughout the views and in which.

DETAILED DESCRIPTION OF THE PREFERRED EMBODIMENT OF THE PRESENT INVENTION

Figure 1:
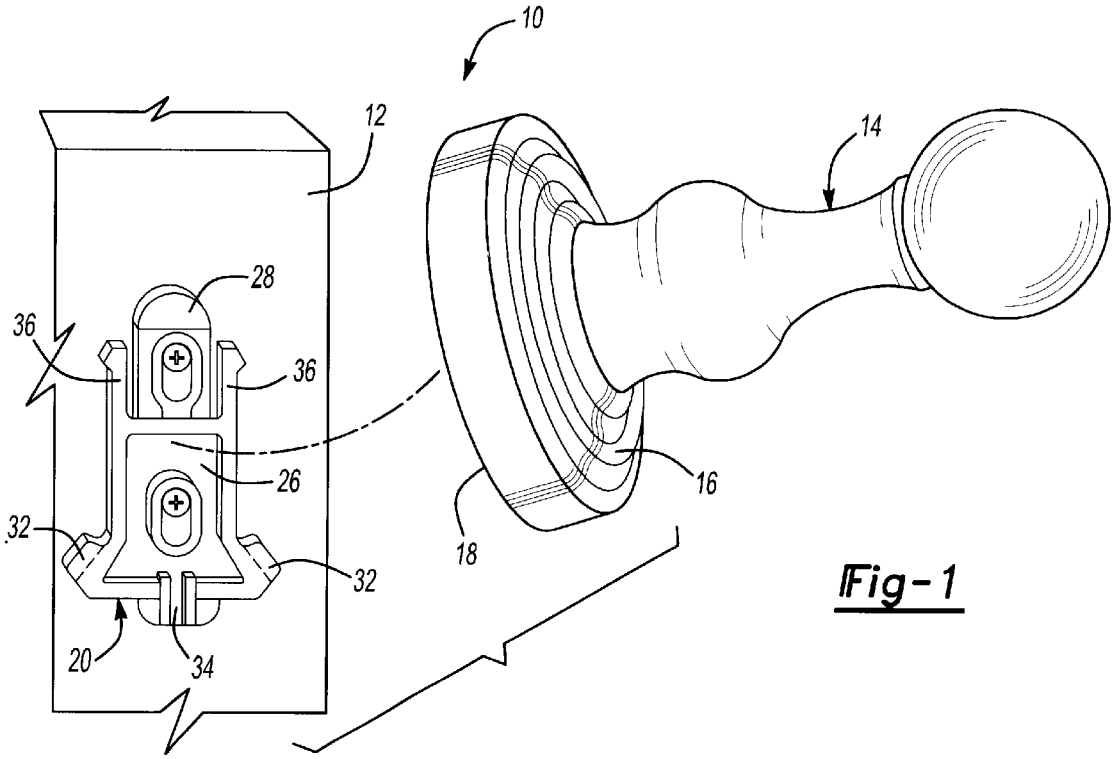
FIG. 1 is an exploded view of the accessory post mounted to the bracket.

Referring first to FIG. 1 of the drawings, there is shown a combination accessory post and mounting bracket 10 for securing articles such as bathroom accessories to a wall 12. The bathroom accessories may include towel bars, towel rings, shelves, soap dishes etc. which are required to be securely mounted to a wall. Additionally, the accessory should be aesthetically appealing free of unsightly mounting hardware. The present invention facilitates secure mounting while completely concealing the mounting hardware.

Figure 2:
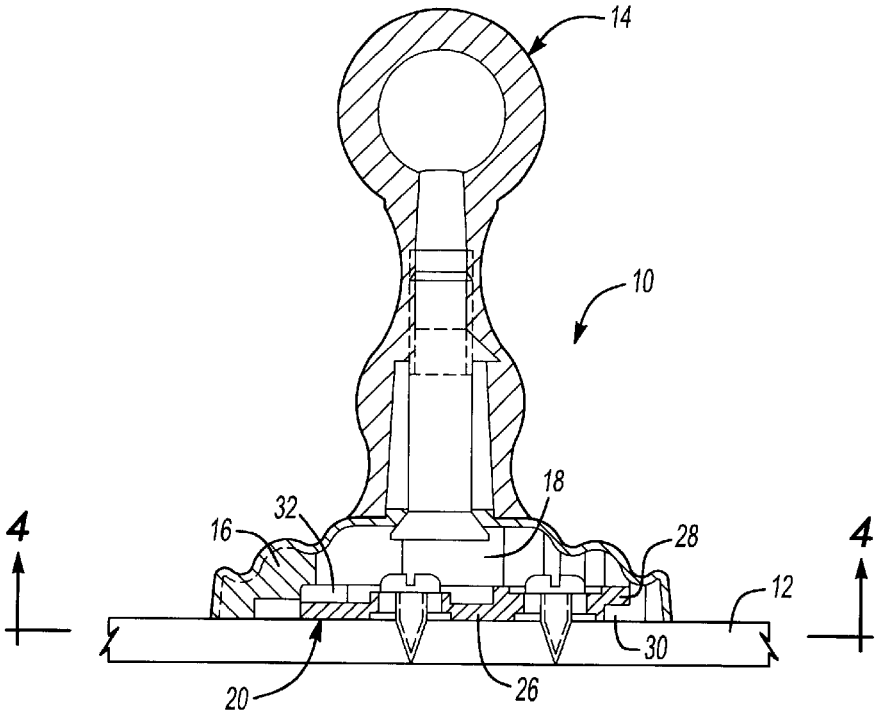
FIG. 2 is a cross-sectional view of the mounting bracket and post.

Referring now to FIGS. 1 and 2, the assembly 10 includes an accessory post 14 forming a part of the wall-mounted accessory. The accessory post 14 preferably includes a base 16 having an interior cavity 18 for accepting and concealing a mounting bracket 20 as will be subsequently described.

The mounting bracket 20 is adapted to be secured to the wall 12 using appropriate fasteners 22 extending through apertures 24 in the mounting bracket 20. The bracket 20 is intended to be mounted to the wall 12 in the orientation shown in FIG. 1 such that gravity assists in maintaining the accessory on the bracket. The bracket 20 has a substantially planar body 26 through which the fasteners 24 extend and which is mounted flush against the wall 12. An upper end of the bracket 20 includes a flange 28 raised above the plane of the body 26 such that a gap 30 is created between the wall 12. Formed along the side edges of the bracket 20 are raised side flanges 32 which similarly form a gap with the wall 12. Extending along a longitudinal axis of the mounting bracket 20 is a slot 34 which works to maintain proper alignment of accessory post 14 on the mounting bracket.

The mounting bracket 20 also includes a pair of locking fingers 36 for lockingly connecting the post 14 and bracket 20. The fingers 36 extend longitudinally along the side edges of the bracket 20. The fingers 36 are flexible to facilitate sliding engagement and include a locking knuckle 38 at the distal end of the fingers 36. All of these components of the mounting bracket 20 cooperate to maintain the post 14 on the bracket 20.

Figure 3:
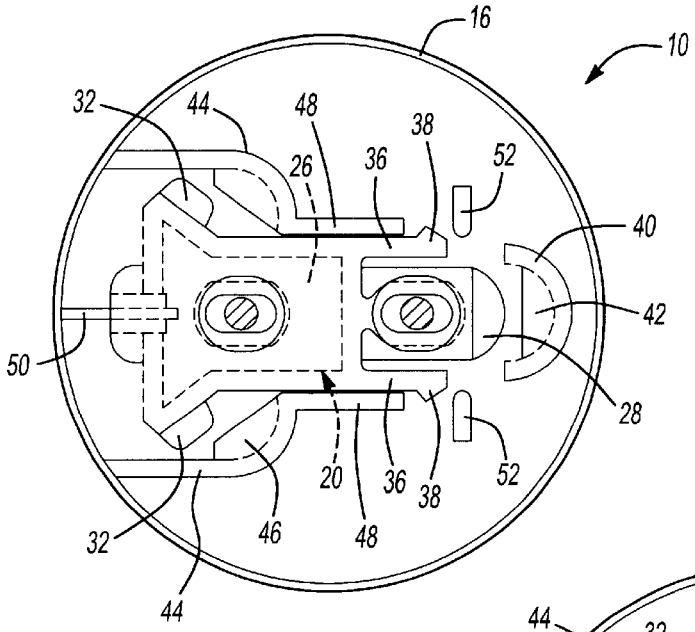
FIG. 3 is a plan view of the mounting bracket with the accessory detached.
Figure 4:
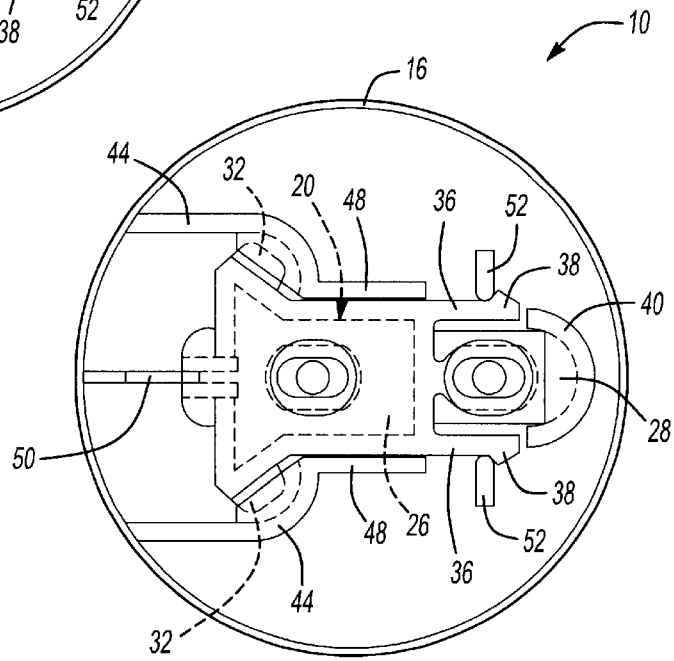
FIG. 4 is a plan view of the mounting bracket with the accessory engaged.

As best shown in FIGS. 3 and 4, the cavity 18 of the post base 16 includes ribs adapted to cooperate with the flange structure of the bracket 20. An upper rib 40 includes a pocket 42 for receiving the upper flange 28. A pair of side ribs 44 similarly include pockets 46 for receiving the side flanges 32. The side ribs 44 include parallel members 48 designed to engage the sides of the bracket 20 and maintain its alignment within the base cavity 18. Similarly, a single axial rib 50 within the cavity 18 engages the slot 34 of the bracket 20 to prevent rotation of the post 14 relative to the bracket 20.

A pair of lateral ribs 52 disposed between the upper rib 40 and the side ribs 44 act as teeth engageable by the flexible fingers 36. As the post 14 is slid onto the bracket 20, the knuckles 38 of the fingers 36 will pass over the lateral ribs 52 to "click " into place. The fingers 36 engaged with the lateral ribs 52 will retard removal of the post from the bracket 20.

The assembly 10 formed by the accessory post 14 and the mounting bracket 20 provides a convenient and simple method of mounting an accessory to the wall 12. Additionally, no exposed fasteners are seen providing a clean elegant appearance. The bracket 20 is mounted on the wall 12 at a predetermined location preferably with the nose flange 28 oriented upwardly. With the bracket 20 mounted to the wall 12, the accessory post 14 can be slid onto the bracket 20. The base 16 is positioned over the bracket 20 such that the alignment rib 50 is inserted within the slot 34 and the parallel ribs 48 engage the sides of the mounting bracket 20. The entire post 14 is then slid downwardly until the side flanges 32 of the bracket 20 are received within their respective side pockets 46 and the upper pocket 42 receives the upper flange 28. Simultaneously, the flexible fingers 36 will engage the lateral ribs 52 to lockingly mount the post 14 to the bracket 20. As a result, the bracket 20 is completely concealed within the cavity 18 of the post 14 and no fasteners are exposed.

The foregoing detailed description has been given for clearness of understanding only and no unnecessary limitations should be understood therefrom as some modifications will be obvious to those skilled in the art without departing from the scope and spirit of the appended claims.

What is claimed is:

1. An accessory mounting system for securing an accessory to a wall, said mounting system comprising:

a bracket adapted to be secured to the wall, said bracket including retaining means;

an accessory post detachably secured to said bracket, said post having a base cavity receiving said bracket to conceal said bracket, said cavity including engagement means for cooperating with said retaining means to detachably secure said post to said bracket; and means for lockingly connecting said post to said bracket including a pair of flexible locking fingers formed on said bracket, said locking fingers selectively engageable with corresponding locking teeth on said post to detachably connect said post to said bracket.

2. The mounting system as defined in claim 1 wherein said engagement means of said accessory post slidably engages said retaining means of said bracket to detachably secure said post to said bracket.

3. The mounting system as defined in claim 2 wherein said retaining means of said bracket including at least one raised flange and said engagement means of said post including at least one pocket whereby said at least one raised flange is received in a corresponding pocket of said post cavity to detachably secure said post to said bracket.

4. The mounting system as defined in claim 3 wherein said mounting bracket includes an upper raised flange and a pair of side flanges.

5. The mounting system as defined in claim 4 wherein said cavity of said post includes an upper pocket and a pair of side pockets.

6. The mounting system as defined in claim 2 wherein said post and said bracket include alignment means for maintaining proper orientation of said post relative to said bracket.

7. The mounting system as defined in claim 6 wherein said alignment means includes an axial rib within said cavity selectively received within an axial slot in said bracket.

8. The mounting system as defined in claim 6 wherein said alignment means includes a pair of parallel ribs within said cavity for engaging side edges of said bracket.

9. An accessory mounting system for securing an accessory to a wall, said mounting system comprising:

a bracket adapted to be secured to the wall, said bracket including retaining means and a pair of flexible locking fingers; and an accessory post detachably secured to said bracket, said post having a base cavity receiving said bracket to conceal said bracket, said cavity including engagement means cooperating with said retaining means and a pair of locking teeth selectively engageable with said flexible locking fingers to detachably secure said post to said bracket.

10. The mounting system as defined in claim 9 wherein said engagement means of said accessory post slidably engages said retaining means of said bracket to detachably secure said post to said bracket.

11. The mounting system as defined in claim 10 wherein said retaining means of said bracket including at least one raised flange and said engagement means of said post including at least one pocket whereby said at least one raised flange is received in a corresponding pocket of said post cavity to detachably secure said post to said bracket.

12. The mounting system as defined in claim wherein 11 said bracket includes an upper raised flange and a pair of side flanges.

13. The mounting system as defined in claim 12 wherein said post and includes an upper pocket and a pair of said pockets.

14. The mounting system as defined in claim 10 wherein said post and said bracket include alignment means for maintaining proper orientation of said post relative to said bracket.

15. An accessory mounting system for securing an accessory to a wall, said mounting system comprising:

a bracket adapted to be secured to the wall, said bracket including retaining means; and an accessory post detachably secured to said bracket, said post having a base cavity receiving said bracket to conceal said bracket, said cavity including engagement means selectively slidably engaging said retaining means of said bracket to detachably secure said post to said bracket;

said base cavity of said accessory post including an axial rib selectively received within an axial slot in said bracket to maintain proper orientation of said post relative to said bracket.

16. The mounting system as defined in claim 15 wherein said retaining means of said bracket including at least one raised flange and said engagement means of said post including at least one pocket whereby said at least one raised flange is received in a corresponding pocket of said post cavity to detachably secure said post to said bracket.

17. The mounting system as defined in claim 16 wherein said mounting bracket includes an upper raised flange and a pair of side flanges.

18. The mounting system as defined in claim 17 wherein said post includes an upper pocket and a pair of said pockets.

19. The mounting system as defined in claim 15 wherein a means for lockingly connecting includes a pair of flexible locking fingers formed on said mounting bracket and selectively engageable with a pair of locking teeth within said cavity of said post.

* * * * *